United States Patent [19]

Duenke

[11] 3,982,629

[45] Sept. 28, 1976

[54] MATCH BOOK

[76] Inventor: Milton J. Duenke, 14796 Sugarwood Trails, Chesterfield, Mo. 63017

[22] Filed: July 9, 1975

[21] Appl. No.: 594,369

[52] U.S. Cl. ..... 206/106; 206/108

[51] Int. Cl.[2] ..... A24F 27/12; A24F 27/00

[58] Field of Search ..... 206/106, 108, 115, 109, 206/118, 113

[56] References Cited

UNITED STATES PATENTS

| | | | |
|---|---|---|---|
| 2,118,726 | 5/1938 | Edwards | 206/108 |
| 2,933,181 | 4/1960 | Will | 206/115 |
| 2,935,185 | 5/1960 | Will | 206/115 |

*Primary Examiner*—William T. Dixson, Jr.
*Attorney, Agent, or Firm*—Gravely, Lieder & Woodruff

[57] ABSTRACT

A match book includes a cover which surrounds a plurality of match sticks extended from a common base. This base is secured to a back panel forming part of the cover. The cover also includes a front panel which overlies the match sticks, a base panel which overlies the base, and an intermediate panel interconnecting the front and base panels and normally folded between them. The front panel has a flap which when raised exposes the match sticks, but the lower end of the flap is normally covered by the intermediate panel. The intermediate panel has a scratch surface which is normally exposed through a window in the overlying base panel. However, the front, intermediate and base panels must be unfolded to free the flap, so that match sticks may be removed, and when unfolded the scratch surface is no longer accessible through the window. Thus, the flap must be closed to strike a match.

10 Claims, 5 Drawing Figures

MATCH BOOK

BACKGROUND OF THE INVENTION

This invention relates in general to match books and more particularly to safety covers for match books.

In the conventional match book, the cover folds around several combs of matches and has a front panel or flap which when the cover is closed fits behind a strike pad suitable for igniting the matches. Most match books of this nature bear a notice stating that the cover should be closed before striking a match, meaning that the flap should be tucked behind the strike pad, but this notice is often ignored. Of course, if the cover is not closed, all of the match heads within the pack are subjected to ignition when one of them is ignited along the strike pad.

Furthermore, the strike pad on conventional match books is exposed on the exterior surface of the cover where it easily absorbs perspiration particularly from the linings of clothing pockets.

SUMMARY OF THE INVENTION

One of the principal objects of the present invention is to provide a match book which minimizes the chances of accidental ignition of the matches within it. Another object is to provide a match book of the type stated in which the match heads are shielded when the scratch surface is positioned for striking a match. A further object is to provide a match book in which the scratch surface is recessed and thereby protected somewhat from moisture, particularly perspiration within a clothing pocket. An additional object is to provide a match book of the type stated which is simple in construction and economical to manufacture. These and other objects and advantages will become apparent hereinafter.

The present invention is embodied in a match book comprising a cover formed from a plurality of connected panels, match sticks within the cover, and a scratch surface on the cover. The cover is such that the scratch surface is inaccessible when the cover is in a position in which the match sticks are exposed and can be withdrawn therefrom. The invention also consists in the parts and in the arrangements and combinations of parts hereinafter described and claimed.

DESCRIPTION OF THE DRAWINGS

In the accompanying drawings which form part of the specification and wherein like numerals and letters refer to like parts wherever they occur.

DETAILED DESCRIPTION

Figure 1:
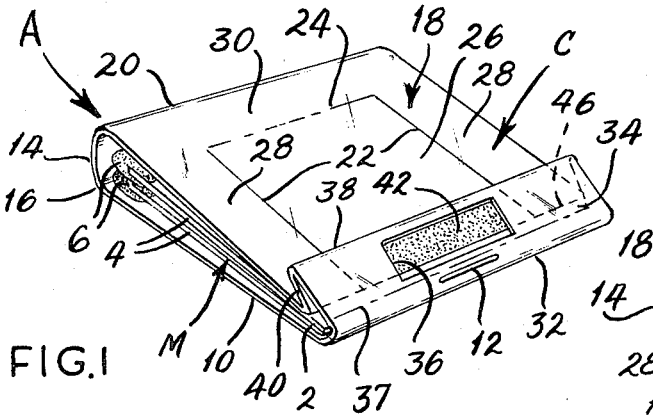
FIG. 1 is a perspective view of the match book of the present invention with the cover thereof being in its folded or closed position.
Figure 2:
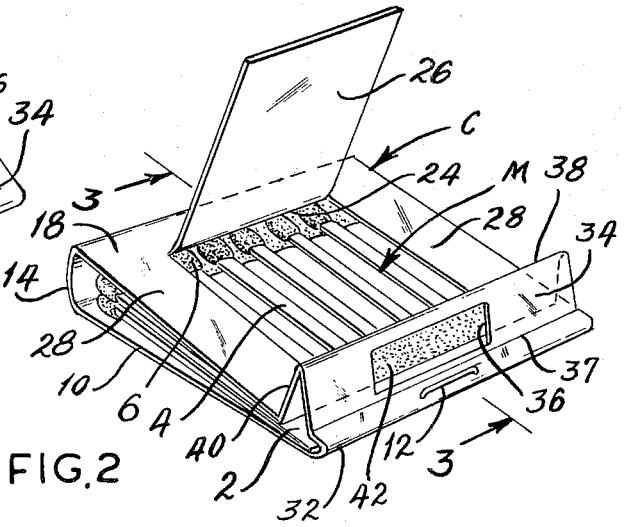
FIG. 2 is a perspective view of the match book with its cover in its unfolded position and the flap open so that match sticks may be withdrawn from the book.

Referring now to the drawings (FIG. 1), A designates a match book including a cover C which surrounds one or two combs of matches M. The match combs M are stapled to the cover C and when the cover C is closed the combs M are more or less enveloped by it.

Each match comb M is stamped from paperboard stock and includes a base 2 and a plurality of match sticks 4 extended from the base 2. The free ends of the sticks 4 are coated to provide match heads 6. The two match combs M are stacked within the cover C with their heads 6 and bases 2 adjacent.

The cover C is formed from a blank B (FIG. 5) of a flexible material such as relatively thin paperboard stock. The cover C includes a back panel 10 which underlies the stacked match combs M with the match combs M being secured to the back panel 10 by a staple 12 extended through the two bases 2 on the match combs M as well as through the back panel 10. The upper end of the back panel 10 extends slightly beyond the heads 6 on the match sticks 4, and at this end the back panel 10 merges into an end panel 14 along a fold line 16. The end panel 14 is wide enough to accommodate several rows of match heads 6, and it in turn merges into a front panel 18 along a fold line 20. The front panel 18 overlies the stacked combs M, and although it extends all the way to the bases 2 of those combs M, it is slightly shorter than the back panel 10.

The front panel 18 has slits 22 located near its side edges, and these slits extend upwardly from the end of the panel 18 located at the base 2 to a transverse fold line 24 which is located slightly below the heads 6 of the match sticks 4. The fold line 24 connects the two slots 22 but does not extend laterally beyond them. The slits 22 along with the transverse fold line 24 divide the front panel 18 into a flap 26, a pair of side connectors 28 which are on each side of the flap 26, and head projector 30 which is located beyond the flap 26 and overlies the heads 6 of the match sticks 4. The flap 26 folds outwardly away from the combs M along a transverse fold line 24 to expose the match sticks 4.

At the lower end of the back panel 10, that is, the end adjacent to the base 2, is a double fold 32, the two folds of which are spaced apart sufficiently to accommodate the stacked bases 2 of the two match combs M. The double fold 32 joins the back panel 10 to a base panel 34 which turns upwardly over the bases 2 of the match combs M and further overlies the lower end of the front panel 18. The staple 12 extends through the base panel 34 close to the double fold 32 to secure the base panel 34 to the combs M. The base panel 34 contains an elongated window 36 and a fold line 37 located between the window 36 and the staple 12. The fold line 37 permits the base panel 34 to fold outwardly away from the combs M.

Figure 4:
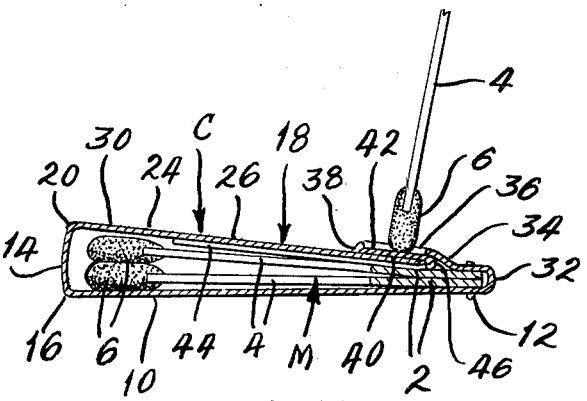
FIG. 4 is a longitudinal sectional view of the cover completely closed and in condition for striking a match.

Joined to the upper end of the base panel 34 along a fold line 38 is an intermediate panel 40 which is somewhat shorter than the base panel 34. When the cover C is in its closed or folded condition (FIG. 1), the intermediate panel 40 is doubled back beneath the base panel 34 and is exposed through the window 36 in the base panel 34. The intermediate panel 40 carries a scratch surface 42 which is accessible through the elongated window 36 only when the cover C is in its folded or closed condition, that is, when the intermediate panel 40 is completely doubled back behind the base panel 34 (FIG. 4).

Near its side margins, the intermediate panel 40 is joined to connectors 44 (FIGS. 3 and 4) along short fold lines 46. The connectors 44 extend upwardly and underlie the side connectors 28 on the front panel 18 to which they are secured, preferably by glue. Indeed, the connectors 44 extended from the intermediate panel 40 marginally register with the side connectors 28 of the front panel 18 so they are practically indiscernible in the match book A. In this regard, when the connectors 28 and 44 are joined, the lower margin of the front panel including the lower margin of its flaps 26 will be at the short fold lines 46 along the intermediate panel 40.

Figure 5:
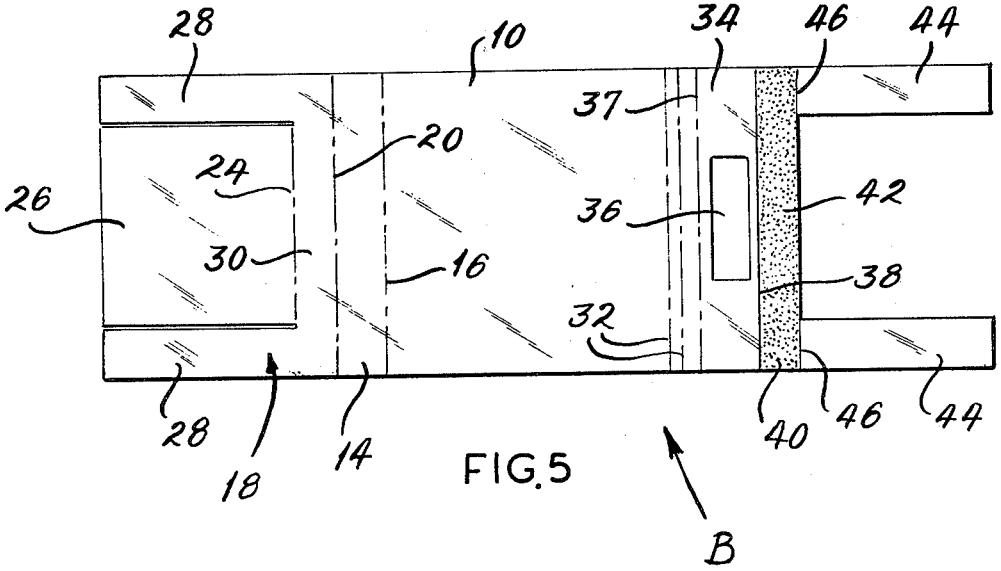
FIG. 5 is a plan view of the blank from which the cover is formed.

The cover C is formed from a blank B which is merely folded into a closed configuration and joined together along the connectors 28 and 44 to complete the cover C (FIG. 5). When the connectors 28 and 44 are joined the intermediate panel 40 as its name implies is located intermediate the front and base panels 18 and 34.

OPERATION

When the match book A is carried or is otherwise not in use, it is in its closed position (FIG. 1). In that position, the intermediate panel 40 lies behind the base panel 34 and the lower end of the front panel 18, including the lower end of its flap 26, lies behind the intermediate panel 40, thus maintaining the flap 26 in a closed condition. Due to the resiliency of the paperboard stock, the intermediate panel 40 does not lie flat against the base panel 34 and the front panel 18, but instead a relatively small angle exists at the fold lines 38 and 44 (FIG. 1). Nevertheless, the flap 26 is still retained behind the intermediate panel 40 which prevents it from being folded outwardly away from the match combs M. Also, since the small angle normally exists between the intermediate panel 40 and the base panel 34, the scratch surface 42 on the intermediate panel 40 lies somewhat behind the elongated window 36 in the base panel 34. This prevents the scratch surface 42 from coming against pocket linings and the like which may be wetted by perspiration. Of course, if the scratch surface 42 becomes wet, it is indeed difficult, if not impossible, to ignite one of the match sticks 4 against it.

Figure 3:
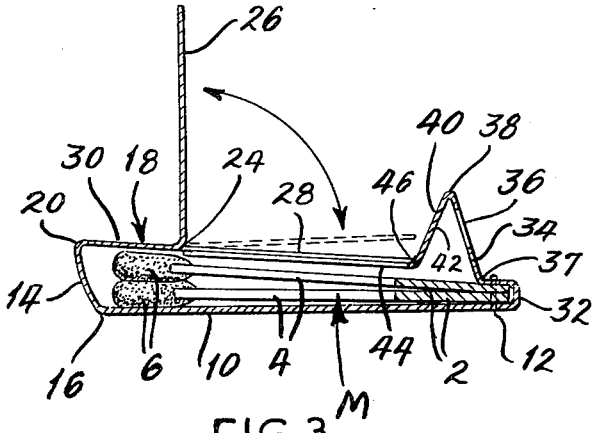
FIG. 3 is a sectional view taken along line 3—3 of FIG. 2.

To withdraw one of the match sticks 4 from the book A, the front panel 18 is grasped along its side margins near the fold line 20 and pulled away from the base panel 34 (FIG. 3). This has the effect of unfolding the three panels 18, 40 and 34, or in other words, bringing the intermediate panel 40 and the lower end of the front panel 18 out from behind the base panel 34. When the panels 18, 40 and 34 are so disposed, the flap 26 may be lifted outwardly away from the match combs M, in which case it bends along the transverse fold line 34. This exposes the match sticks 4 of combs M. One of the match sticks 4 is torn from its base 2 in the usual manner and withdrawn through the opening left on the front panel 18 by the outwardly folded flap 26. However, when the panels 18, 40 and 34 are in their unfolded condition, the scratch surface 42 on the intermediate panel 40 is located substantially beyond the window 36. As a consequence, it is inaccessible and the head 6 of the withdrawn match stick 4 cannot be moved across it.

To ignite the match head 6 of the withdrawn match stick 4, the flap 26 is pushed downwardly to a position flush with the connectors 28 on each side of it, and this has the effect of forcing the lower end of the front panel 18 below the upper end of the base panel 34 so that the intermediate panel 40 is at a substantial angle with respect to the two panels 34 and 40. Then the front panel 18 is forced toward the double fold 32 at the bottom of the base panel 34, while the base panel 34 is pressed toward the match combs M. This causes the panels 18, 40 and 34 to lie flat against one another with the intermediate panel 40 interposed between the base panel 34 and the lower end of the front panel 18 (FIG. 4). When the panels 18, 40 and 34 are so disposed, the scratch surface 42 is located directly behind and is easily accessible from the elongated window 36.

The match head 6 may be struck on the exposed scratch surface 42 to ignite it. Since the flap 26 is closed, the remaining match sticks 4 and particularly the heads thereof are protected from the flame.

While the cover C may be moved to its closed position with the flap 26 bent outwardly, this is a cumbersome operation since the normal tendency is to press against the flap 26 to bring the cover C back to its folded or closed position. Furthermore, when the flap 26 is out and the panels 18, 40 and 34 are in their folded condition, the lower end of the flap 26 will lie over the elongated window 36 and prevent access to the scratch surface 42.

Thus, for all practical purposes, it is impossible to strike one of the match sticks 4 without the flap 26 in its closed condition, that is, flush with the side connectors 28 and having its lower end behind the intermediate panel 40.

This invention is intended to cover all changes and modifications of the example of the invention herein chosen for purposes of the disclosure which do not constitute departures from the spirit and scope of the invention.

What is claimed is:

1. A match book comprising: a cover formed from a plurality of connected panels which move to a closed position, said plurality of panels including a front panel and an intermediate panel which is connected to one end of the front panel along a first fold line such that movement of the front panel in one direction will change the inclination of the intermediate panel relative to the front panel; a plurality of match sticks within the cover such that the cover surrounds and protects the match sticks, the match sticks being arranged in at least one row over which the front panel lies with the sticks extending generally parallel to said one direction of movement for the front panel, the match sticks having heads formed from a combustible material; and a scratch surface on the intermediate panel and formed from a material which will cause a match head to ignite when moved over the material, the scratch surface being exposed and accessible when the cover is in its closed condition, but not when the cover is moved out of its closed position.

2. A match book according to claim 1 wherein the cover further comprises a base panel connected to the intermediate panel along a second fold line which is parallel to the first fold line such that intermediate panel is interposed between the base panel and the front panel with the base panel generally covering the intermediate panel when the cover is in its closed position.

3. A match book according to claim 2 wherein the base panel contains a window through which the scratch surface on the intermediate panel is exposed when the cover is closed.

4. A match book according to claim 3 wherein the front panel contains a flap which folds outwardly away from the match sticks along a third fold line to expose the match sticks, the flap having a free end located near the first fold line, whereby the free end of the flap will be located behind the intermediate panel and cannot be opened when the cover is in its closed position.

5. A match book according to claim 4 wherein the cover further comprises an end panel located beyond the match heads and at an angle to the front panel, the end panel being connected to the front panel along a fourth fold line which is parallel to the first, second, and third fold lines, the fourth fold line being spaced from the third fold line such that the intervening portion of the front panel is of sufficient width to extend over the match heads.

6. A match book according to claim 5 wherein the cover further comprises a back panel connected to the end panel along a fifth fold line and also to the base panel along a sixth fold line, the back panel lying beyond the row of match sticks and the match sticks being secured to the back panel.

7. A match book comprising: a comb of match sticks having a base for the match sticks and ignitable heads on said match sticks remote from said base; a cover for said comb of match sticks, said cover having a back panel supporting said comb base, a base panel folded over said comb base and containing a window, staple means securing said comb base to and between said back and base panels, an intermediate panel foldably connected to said base panel and movable between a first position elevating said base panel and a second folded position under said base panel to be exposed through the window, a front panel foldably connected to said back panel adjacent said match stick heads and being operably connected to said intermediate panel, a flap in said front panel movable out of said front panel to open the cover and causing said intermediate panel to move into said first position, said flap being movable into said front panel to cause said intermediate panel to move into said second folded position; and a striking surface on said intermediate panel in position to be exposed through said window in the base panel in said second folded position and being wiithdrawn when in said first position of said intermediate panel.

8. A match book comprising: a comb of match sticks, the comb including a common base from which the match sticks extend generally parallel to each other, the match sticks having ignitable heads located thereon remote from the comb base; a cover surrounding the comb, the cover including a back panel underlying the comb, a base panel overlying the comb base and having a window therein, a front panel foldable with respect to the back panel and overlying a substantial portion of the match sticks and the head thereon, the front panel being movable in the direction generally parallel to the match sticks, an intermediate panel interposed between and foldably connected to the base panel and the intermediate panel such that movement of the front panel in one direction parallel to the match sticks will cause the intermediate panel to assume an inclined position wherein it is at a substantial angle with respect to the comb and front panel and such that movement of the front panel in the opposite direction parallel to the match sticks will cause the intermediate panel to assume a flat position wherein it lies generally flat over the front panel and directly behind the base panel with the intermediate panel being accessible through the window of the base panel when in its flat position, and a flap in the front panel and having its free end near the intermediate panel, the flap being movable between a closed position wherein it is generally flush with the remainder of the front panel and an open position wherein it is folded outwardly from the remainder of the front panel and the match sticks are exposed, the flap being movable to its open position when the intermediate panel is in its inclined position but being retained in its closed position when the intermediate panel is in its flat position; means for securing the comb at the comb base to the cover in the vicinity of the base panel; and a scratch surface on the intermediate panel and being formed from a material which will cause a match of the comb to ignite when the head thereof is moved over the material, the scratch surface being accessible through the window in the base panel when the intermediate panel is in its flat position.

9. A match book according to claim 8 wherein the cover further includes an end panel which is adjacent to the ignitable heads and is foldably connected to and interposed between the front panel and the back panel.

10. A match book according to claim 8 wherein the means for securing the comb to the cover attaches the comb base to both the back panel and the base panel of the cover.

* * * * *